United States Patent [19]

Kubilos

[11] 4,289,452

[45] Sep. 15, 1981

[54] PRESSURE COMPENSATED PUMP

[75] Inventor: Charles A. Kubilos, Oxnard, Calif.

[73] Assignee: Abex Corporation, New York, N.Y.

[21] Appl. No.: 16,739

[22] Filed: Mar. 5, 1979

[51] Int. Cl.[3] ..... F04B 1/26

[52] U.S. Cl. ..... 417/222; 60/452

[58] Field of Search ..... 417/218, 222; 60/452

[56] References Cited

U.S. PATENT DOCUMENTS

| | | | |
|---|---|---|---|
| 2,835,228 | 5/1958 | Parr et al. | 417/222 X |
| 3,186,353 | 6/1965 | Taplin | 417/218 |
| 4,074,529 | 2/1978 | Budzich | 60/452 X |

*Primary Examiner*—Carlton R. Croyle
*Assistant Examiner*—Edward Look
*Attorney, Agent, or Firm*—Thomas S. Baker, Jr.; David A. Greenlee

[57] ABSTRACT

A pressure compensated pump has a pressure compensator valve connected to a stroking piston. When the discharge pressure exceeds a set maximum the compensator valve connects pressure fluid to the stroking piston to reduce the displacement of the pump. The flow of pressure fluid to the stroking piston is accompanied by a concurrent flow of fluid to case.

4 Claims, 5 Drawing Figures

FIG. 1
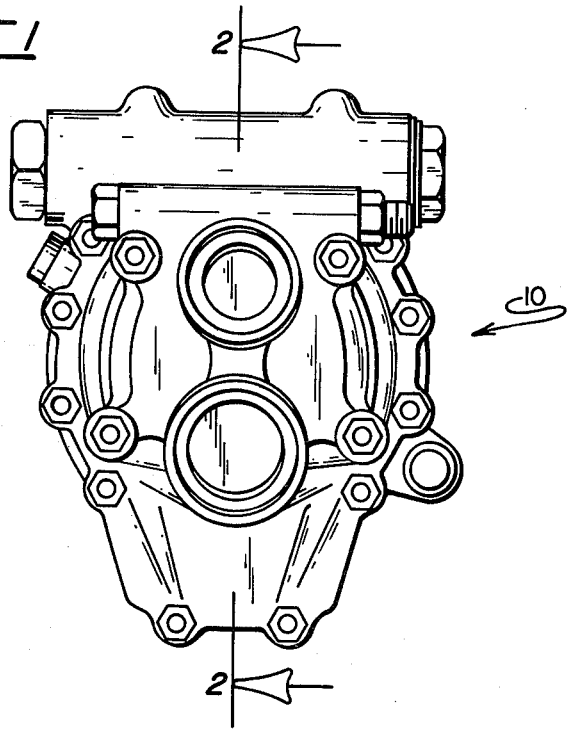
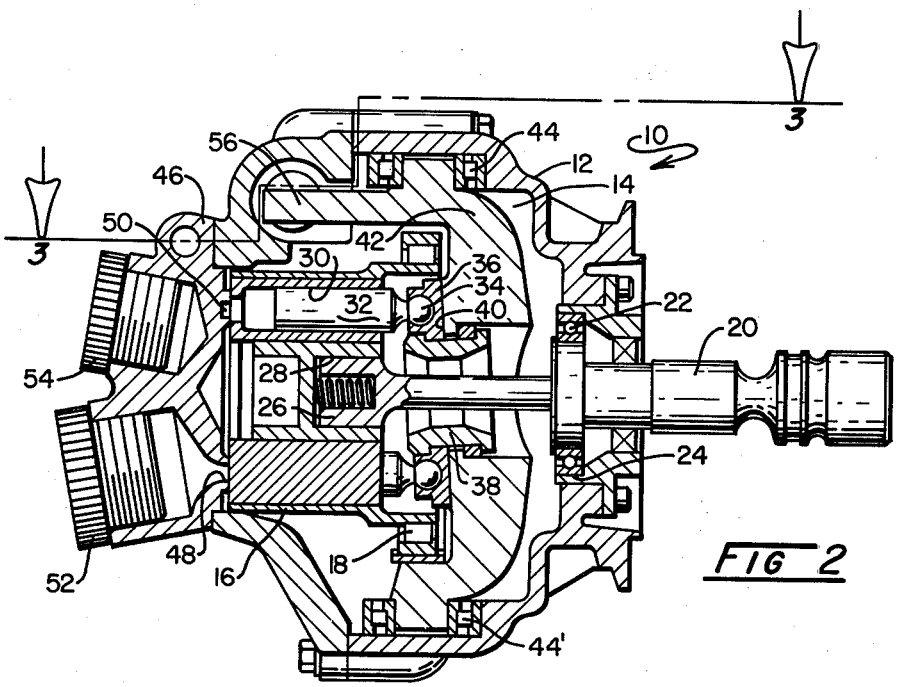
FIG 2

PRESSURE COMPENSATED PUMP

BACKGROUND OF THE INVENTION

This invention relates to a flow control valve for a variable displacement pressure compensated piston pump.

A variable displacement piston pump includes a rotatably mounted pump barrel having a plurality of longitudinal bores in which a piston is mounted. Each piston has a shoe pivotally attached to a head end which projects from the barrel. The shoes are retained against a swash plate formed on one surface of a hanger which is pivotally mounted in the pump housing. A prime mover rotates the barrel and the pistons reciprocate as the piston shoes slide over the swash plate. The angle of the swash plate determines the displacement of the pump. If the hanger is centered, i.e. off-stroke, the swash plate is parallel to the ends of the shoes and the pistons do not reciprocate. If the hanger is not centered, i.e. on-stroke, the swash plate is angled with respect to the ends of the shoes and the pistons reciprocate as the barrel is rotated.

The pump can be put on-stroke by a spring which biases the hanger to a full on-stroke position. Maximum displacement of the pump is set by a stop which limits the maximum angle of the hanger.

A pressure compensator valve is used to sense the pressure of the discharge fluid from the pump and supply pressure fluid to a stroking piston which moves the hanger from the on-stroke position towards the centered position when the pressure of the discharge fluid exceeds a set limit. The stroking piston moves the hanger until it reaches a displacement setting at which the discharge pressure is at the set limit.

A common problem with a pressure compensated pump is instability or hunting. One reason instability occurs is that, when the setting of the pressure compensator valve is exceeded, it directs high pressure discharge fluid to the stroking piston. The inrush of high pressure fluid causes rapid movement of the piston which results in rapid movement of the hanger. A small change in the angle of the hanger results in a large change in pump displacement and the rapid movement of the stroking piston causes the displacement to be reduced very quickly. By the time the compensator valve senses that the discharge pressure has fallen to the set amount and moves to block the flow of fluid to the stroking piston the piston has reduced the hanger angle beyond what is necessary to maintain the set pressure of the discharge fluid. Consequently, the compensator spool must move to drain fluid from the stroking piston to allow the spring to put the pump more on-stroke. If too much fluid is drained from the stroking piston, the hanger is too far on-stroke, the pressure of the discharge fluid is above the setting of the compensator valve, and the cycle repeats itself.

This problem is aggravated by the fact that typically a light spring biases the hanger on-stroke and a relatively small stroking piston is used in order to satisfy the requirement that the pump be compact.

If the large inrush of high pressure fluid to the strolling piston when the pressure of the discharge fluid exceeds the setting of the valve could be avoided, the large initial drop in discharge fluid pressure caused by too much hanger movement could be eliminated, and the pump output would stabilize more quickly. Therefore, it is desirable to find a means of damping the response of the stroking piston when it is connected to the discharge pressure fluid.

One method to reduce the sensitivity of the system is to require a greater flow of fluid from the pressure compensator valve to provide a given amount of travel of the stroking piston. This could be accomplished by having a larger stroking piston. However, this increases the size of the package which is undesirable.

SUMMARY OF THE INVENTION

The present invention provides a pressure compensated axial piston pump which has greatly improved stability without an enlarged stroking piston. In the instant invention, a fluid passage connected to case is connected in parallel with the fluid passage between the pressure compensator valve and the stroking piston. These passages are mechanically aligned so that any flow of discharge pressure fluid to the stroking piston is accompanied by a parallel flow of the fluid to case. This provides for an increased flow of fluid from the pressure compensator valve when the discharge pressure exceeds the setting of the valve, which substantially decreases the sensitivity of the system.

DRAWINGS

FIG. 1 is a front view of the pump looking at the intake and discharge ports;

FIG. 2 is an axial section taken along line 2—2 of FIG. 1;

DESCRIPTION OF THE PREFERRED EMBODIMENT

Figure 3:
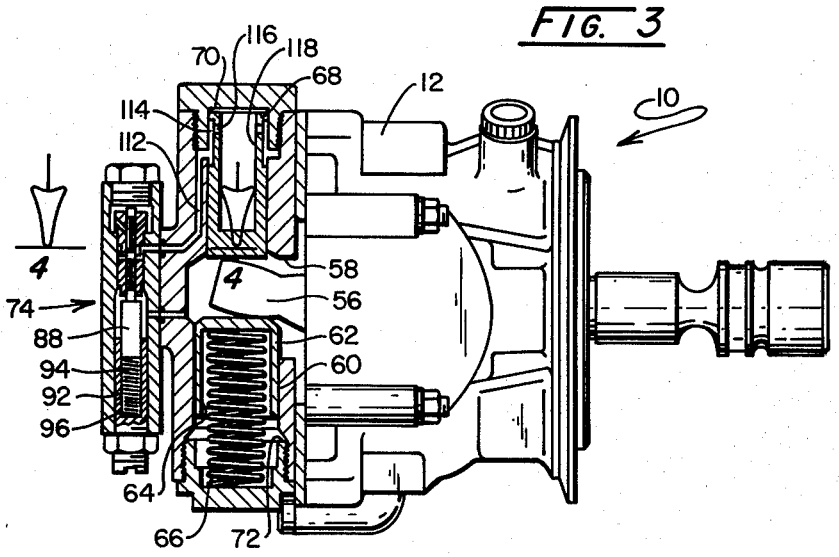
FIG. 3 is a sectional view taken along line 3—3 of FIG. 2.

Referring to FIGS. 1-3 of the drawings, the variable displacement pump 10 of the instant invention includes a housing 12 which defines a hollow chamber 14. A cylindrical barrel 16 is mounted in a roller bearing 18 which is seated in housing 12. The barrel 16 is driven by a drive shaft 20, which is supported in a bearing 22, mounted in an opening 24 in housing 12 and has one end 26, connected to barrel 16 through a splined connection 28.

A plurality of parallel, equally spaced, longitudinal bores 30 are formed in barrel 16. Each bore 30, receives a piston 32, which has a cylindrical head 34 which projects beyond bore 30 and mounts a shoe 36. A hold down or retaining plate 38 has a plurality of bores which receive each of the pistons 32, and clamp the shoes 36 against a swash plate surface 40, formed on a pivotal yoke or hanger 42. Hanger 42 is mounted in a pair of bearings 44, 44' for pivotal movement about an axis perpendicular to the longitudinal axis of barrel 16.

A port cap 46 is mounted on one end of housing 12 and has an inlet port 48 and an exhaust port 50 adjacent one end of barrel 16. Couplings 52, 54 are provided adjacent the respective ports 48 and 50, to supply fluid to and to receive fluid from the pump 10.

Referring to FIG. 2, it can be seen that if swash plate surface 40 is parallel with the end of barrel 16 and the bottom of shoes 36, the pistons 32 will not reciprocate in the bores 30, and no pumping action will take place. In this position, the hanger is off-stroke. Accordingly, it is necessary that the hanger 42 be angled with respect to the end of barrel 16 in order to have the pump displace fluid.

Referring to FIG. 3, it can be seen that an arm 56 attached to hanger 42, projects through an opening 58 in housing 12 into a cylindrical bore 60. A piston 62, mounted in bore 60, has an axial bore 64 which receives a spring 66, and acts against arm 56 to bias the hanger 42 to a position at which the swash plate surface 40 is at a maximum angle with respect to barrel 16, which is the full on-stroke position. A stroking piston 68, which is also slidable in bore 60, engages the opposite side of hanger arm 58. The maximum angle of hanger 12 is set when stroking piston 68 is seated against end cover 70 which closes one end of bore 60.

It is necessary to reduce the displacement of the pump 10 when the pressure of the discharge fluid becomes excessive. Under this condition, fluid is supplied to the stroking piston 68 to move hanger arm 56 downward and reduce the displacement of the pump 10 until the pressure of the discharge fluid reaches the maximum setting. If the pressure of the discharge fluid falls below the maximum setting, a fluid passage to the stroking piston 68 is opened to case and spring 66 moves hanger arm 56 upwardly and sets the pump 10 more on-stroke.

Figure 4:
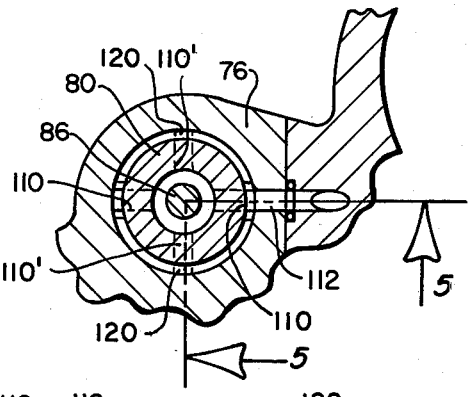
FIG. 4 is a transverse section of the compensator valve taken along line 4—4 of FIG. 3.
Figure 5:
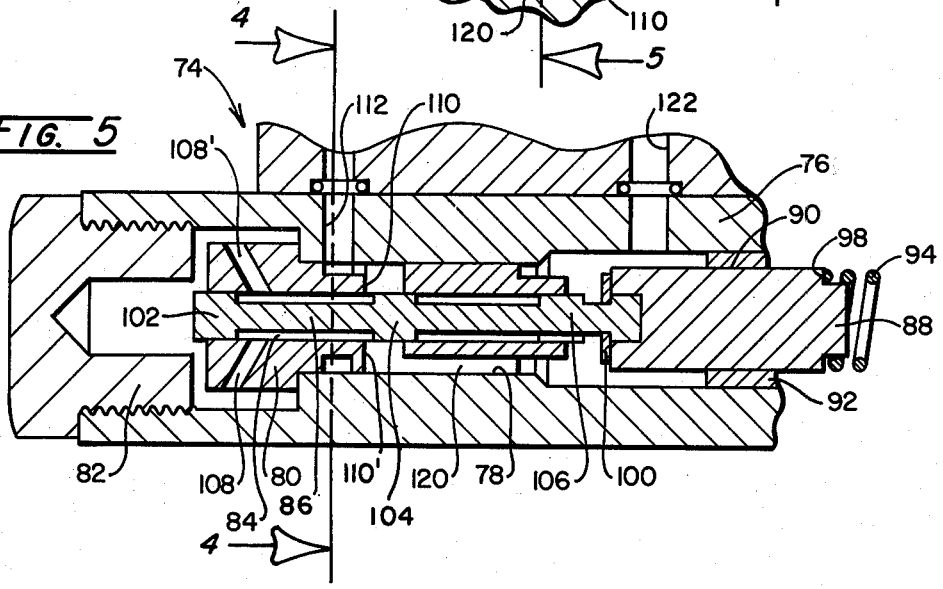
FIG. 5 is an axial section of the compensator sleeve and spool taken along line 5—5 of FIG. 4.

A pressure compensated flow control valve 74 controls the ingress and egress of fluid to stroking piston 68 as will now be described. Referring to FIGS. 3, 4, and 5, flow control valve 74 includes a housing 76 which has a through axial bore 78. A sleeve 80 is mounted in one end of bore 78 and is retained in place by an end cap 82. Sleeve 80 has an axial bore 84 which receives a compensator spool 86. A second spool 88, is attached to one end of compensator spool 86 and is slidable in a bore 90 formed in a sleeve 92 which is threaded into valve housing 76. A spring 94, which acts between one end 96 of bore 90 and a shoulder 98 on spool 88, biases spool 88 and compensator spool 86 toward end cap 82. A stop 100 limits the travel of spool 88.

Compensator spool 86 is supported in bore 84 by three lands 102, 104, 106. A pair of inlet passages 108, 108', formed in sleeve 80, connect the outer surface of sleeve 80 with the space between lands 102, 104. A first control port 110, formed in sleeve 80, is connected to a fluid passage 112 which opens into bore 60, adjacent a groove 114, formed in stroking piston 68. A lateral bore 116, in piston 68, provides a fluid conduit between an axial bore 118 in one end of the piston 68 and groove 114. A second control port 110' which is isolated from the first control port 110 is also formed in sleeve 80.

A slot 120 formed in sleeve 80 connects control port 110' to the space adjacent spool 88. This space is connected to case via a fluid conduit 122.

Operation of the pressure compensated flow control valve 74 will now be described. Discharge pressure fluid is received in the flow control valve 74 in the space around the enlarged end of sleeve 80 from a conduit not shown. The discharge pressure fluid flows through inlet passages 108, 108' in sleeve 80 and acts on one side of compensator spool land 102. The force of this fluid is resisted by spring 94 which sets the maximum pressure of the discharge fluid for the control valve 74. This pressure can be adjusted by turning sleeve 92 further into or out of housing 76 to increase or decrease the force on spring 94. When the pressure of the discharge fluid exceeds the setting of the control valve, the fluid pressure on land 102 overcomes the force on spring 94 and moves land 104 to the right as viewed in FIG. 5. This uncovers control ports 110, 110' and permits pressure fluid to flow through port 110 into fluid passage 112 which opens into stroking piston bore 60. The fluid flows around groove 114 in stroking piston 68, through bore 116 and into the end of the piston 68. The pressure fluid moves the stroking piston 68 away from end cover 70 which moves hanger arm 56 towards a reduced displacement position. At the same time, control port 110 is uncovered and fluid starts to flow into fluid passage 112, port 110' is also uncovered and some of the discharge pressure fluid flows through slot 120 directly to case. The fluid passages are sized such that when pressure fluid is supplied to control ports 110, 110' the amount of fluid that flows into fluid passage 112 to stroking piston 68 is substantially less than the amount of fluid that flows through slot 120. This decreases the amount of high pressure discharge fluid that flows into the stroking piston 68 during a given time and substantially reduces its sensitivity. In the instant invention a ratio of flow to case and to the stroking piston of ten to one, has been found to be satisfactory. Of course, this ratio can be changed by sizing passage 112 and slot 120 to meet different requirements.

The parallel flow of discharge pressure fluid to the stroking piston and to case has two distinct advantages. The first advantage is that it offers an immediate path for the high pressure discharge fluid to case without having to wait for the stroking piston to reduce the hanger angle. The second advantage, is that the stroking piston moves slower and does not initially reduce the hanger angle beyond what is required to just maintain fluid at the setting of the conrol valve 74. This makes the pump 10 much more stable and substantially reduces hunting.

In the event that hanger 42 is at a reduced displacement position and the pressure of the discharge fluid falls below the set amount, spring 94 moves compensator spool 86 to the left and connects control groove 110 to case through slot 120. This permits fluid to drain from behind stroking piston 68 as spring 66 forces hanger arm 56 more on-stroke.

I claim:

1. A pressure compensated piston pump comprising a casing, a barrel rotatably mounted in the casing, a plurality of bores in the barrel, a piston mounted for reciprocation in each bore, a shoe mounted on the end of each piston, a hanger pivotally mounted in the casing, a thrust plate attached to the hanger, means for connecting the pistons to the thrust plate wherein the shoes slide over the thrust plate when the barrel is rotated and the pistons reciprocate in their bores when the hanger is on-stroke, the hanger is movable between an off-stroke position in which the pump displacement is a minimum and a full on-stroke position in which the pump displacement is a maximum, means for biasing the hanger to the full on-stroke position, a stroking piston which receives fluid and moves the hanger toward the off-stroke position when the pressure of the discharge fluid exceeds a predetermined maximum, a pressure compensator valve including a spool bore, a spool movable in the bore, means for setting the maximum discharge pressure of the pump, means for sensing the discharge pressure of the pump, a first control port, a first fluid passage connecting said first control port to the stroking piston, a second control port, a second fluid passage connecting said second control port to drain, a control land formed on said spool which cooperates with said first and second control ports to form first and second variable orifices which control the flow of fluid to and from the first and second control ports, first means for connecting discharge pressure fluid to one side of the control land, a second means for connecting low pressure fluid to the other side of the control land, and the spool is movable alternatively between a first position in which said control land blocks said first and second control ports, a second position in which said first and second control ports are open to the second connecting means and drain, and a third position in which the first and second control ports are open to the first connecting means that discharge pressure is supplied to the first control port to move the stroking piston towards the off-stroke position and simultaneously discharge pressure fluid is supplied to drain through the second control port.

2. A pressure compensated pump as set forth in claim 1, wherein the first control port is independent from the second control port.

3. A pressure compensated pump as set forth in claim 2, wherein the second fluid passage is larger than the first fluid passage and a greater amount of fluid flows to drain than to the stroking piston when the spool is in the third position.

4. A pressure compensated pump as set forth in claim 1, wherein the movement of said spool and the flow of discharge pressure fluid through the first fluid passage and the second fluid passage is proportional to the difference between the set and the actual discharge pressure of the pump.

* * * * *

UNITED STATES PATENT OFFICE

CERTIFICATE OF CORRECTION

PATENT NO. : 4,289,452

DATED : September 15, 1981

INVENTOR(S) : Charles A. Kubilos

It is certified that error appears in the above-identified patent and that said Letters Patent are hereby corrected as shown below:

Col. 1, line 62 - "strol-" should read --strok---

Col. 4, line 32 - "conrol" should read --control--

Col. 4, line 38 - "groove 110" should read --ports 110, 110'--

Signed and Sealed this

*Twenty-second* Day of *December 1981*

[SEAL]

*Attest:*

GERALD J. MOSSINGHOFF

*Attesting Officer*

*Commissioner of Patents and Trademarks*